United States Patent [19]

Dorfman

[11] Patent Number: 5,026,237

[45] Date of Patent: Jun. 25, 1991

[54] METHOD AND APPARATUS FOR CRIMPING A CONTAINER CAP

[75] Inventor: Jan L. Dorfman, Littleton, Colo.

[73] Assignee: Coors Brewing Company, Golden, Colo.

[21] Appl. No.: 469,255

[22] Filed: Jan. 24, 1990

[51] Int. Cl.[5] ..... B21D 51/34

[52] U.S. Cl. ..... 413/43; 72/453.5; 413/42

[58] Field of Search ..... 413/3, 4, 5, 26, 27, 413/42, 43; 72/391, 453.5

[56] References Cited

U.S. PATENT DOCUMENTS

| | | | |
|---|---|---|---|
| 471,925 | 3/1892 | Whitaker | 413/42 |
| 3,410,456 | 11/1968 | Johnson, Jr. et al. . | |
| 3,592,351 | 7/1971 | Johnson, Jr. . | |
| 4,000,829 | 1/1977 | Johnson, Jr. et al. . | |
| 4,084,525 | 4/1978 | Booth . | |
| 4,202,456 | 5/1980 | Silber . | |
| 4,445,310 | 5/1984 | Scheidegger . | |
| 4,679,679 | 7/1987 | Lech, Jr. et al. . | |
| 4,773,553 | 9/1988 | Van Brocklia . | |

FOREIGN PATENT DOCUMENTS

| | | | |
|---|---|---|---|
| 745194 | 5/1933 | France | 413/26 |
| 0132332 | 8/1983 | Japan | 413/26 |
| 0421167 | 12/1934 | United Kingdom | 413/26 |

OTHER PUBLICATIONS

Adolph Coors Drawing No. 1087157 and Information Disclosure Statement re same dated 1/23/90.

*Primary Examiner*—Frederick R. Schmidt
*Assistant Examiner*—Jack Lavinder
*Attorney, Agent, or Firm*—Klaas & Law

[57] ABSTRACT

A crimping tool for attaching a cap member to a container neck flange, including a nest member for axially locating the crimping tool at a predetermined position relative to the cap member; a unitary collet member mounted on the nest member for engaging and crimpingly deforming the cap member about the container neck flange; a sleeve member positioned in circumscribing relationship with the collet member in axially displaceable relationship therewith for engaging a lower portion of the collet member and urging the collet member into crimping relationship with the cap member during axial displacement of the sleeve member relative the collet member; and an axial displacement member mechanically linked to the collet member and the sleeve member for selectively axially displacing the sleeve member relative the collet member is disclosed. A method for crimping a cap member including the steps of: positioning a unitary, integrally formed collet member in circumscribing relationship about the cap member; and elastically, inwardly deforming the collet member so as to engage and crimpingly deform the cap member is also disclosed.

9 Claims, 3 Drawing Sheets

METHOD AND APPARATUS FOR CRIMPING A CONTAINER CAP

BACKGROUND OF THE INVENTION

The present invention relates generally to crimping tools and, more particularly, to a method and apparatus for crimping a cap onto a container.

Some specialty beverage containers, such as those sold under the product designation "PARTY BALL" by ADOLPH COORS COMPANY, of Golden, Colorado, are capped by operators using hand-held cap attachment devices known in the industry as "crimping tools" or simply "crimpers". A crimper bends an axially extending skirt portion of a container cap around a flange portion of a container neck to secure the cap to the container. Crimpably attachable container capping assemblies are described in applicant's commonly assigned copending application Ser. No. 450,924 filed Dec. 14, 1989, and entitled CLOSURE ASSEMBLY FOR PRESSURIZED PLASTIC BEVERAGE CONTAINER, which is hereby specifically incorporated by reference for all that it discloses.

Prior art crimping tools include those sold by Johnson Enterprises, Inc., of 220 North 4th Street, Rockford, Ill., 61107, under model designation T-BS-021. Such tools are relatively complex and have many individual moving parts including multiple individual "jaw" or "finger" members. Such prior art crimpers require frequent adjustment because of tool wear and other tolerance-effecting variations inherent in a design with numerous moving parts. A related problem is that cleaning and other maintenance operations for such crimpers are relatively expensive due to the time required to disassemble and reassemble complex mechanical assemblies. Yet another problem with prior art crimpers has been that rubber or other elastomeric sealing members have been employed. Such elastomeric members are more subject to wear than metal members and are also more difficult to clean. A need thus exists for a crimping tool which overcomes these problems of the prior art.

SUMMARY OF THE INVENTION

The present invention may comprise a crimping tool for attaching a cap member to a container neck flange, comprising: (a) nest means for axially locating said crimping tool at a predetermined position relative to said cap member; (b) unitary collet means mounted on said nest means for engaging and crimpingly deforming said cap member about said container neck flange; (c) sleeve means positioned in circumscribing relationship with said collet means in axially displaceable relationship therewith for engaging a lower portion of said collet means and urging said collet means into crimping relationship with said cap member during axial displacement of said sleeve means relative said collet means; and (d) axial displacement means mechanically linked to said collet means and said sleeve means for selectively axially displacing said sleeve means relative said collet means.

The present invention may also comprise a method for crimping a cap member comprising the steps of: (a) positioning a unitary, integrally formed collet member in circumscribing relationship with the cap member; and (b) elastically, inwardly deforming the collet member so as to engage and crimpingly deform the cap member.

BRIEF DESCRIPTION OF THE DRAWINGS

An illustrative and presently preferred embodiment of the invention is shown in the accompanying drawings in which.

DETAILED DESCRIPTION OF THE INVENTION

In General

Figure 1:
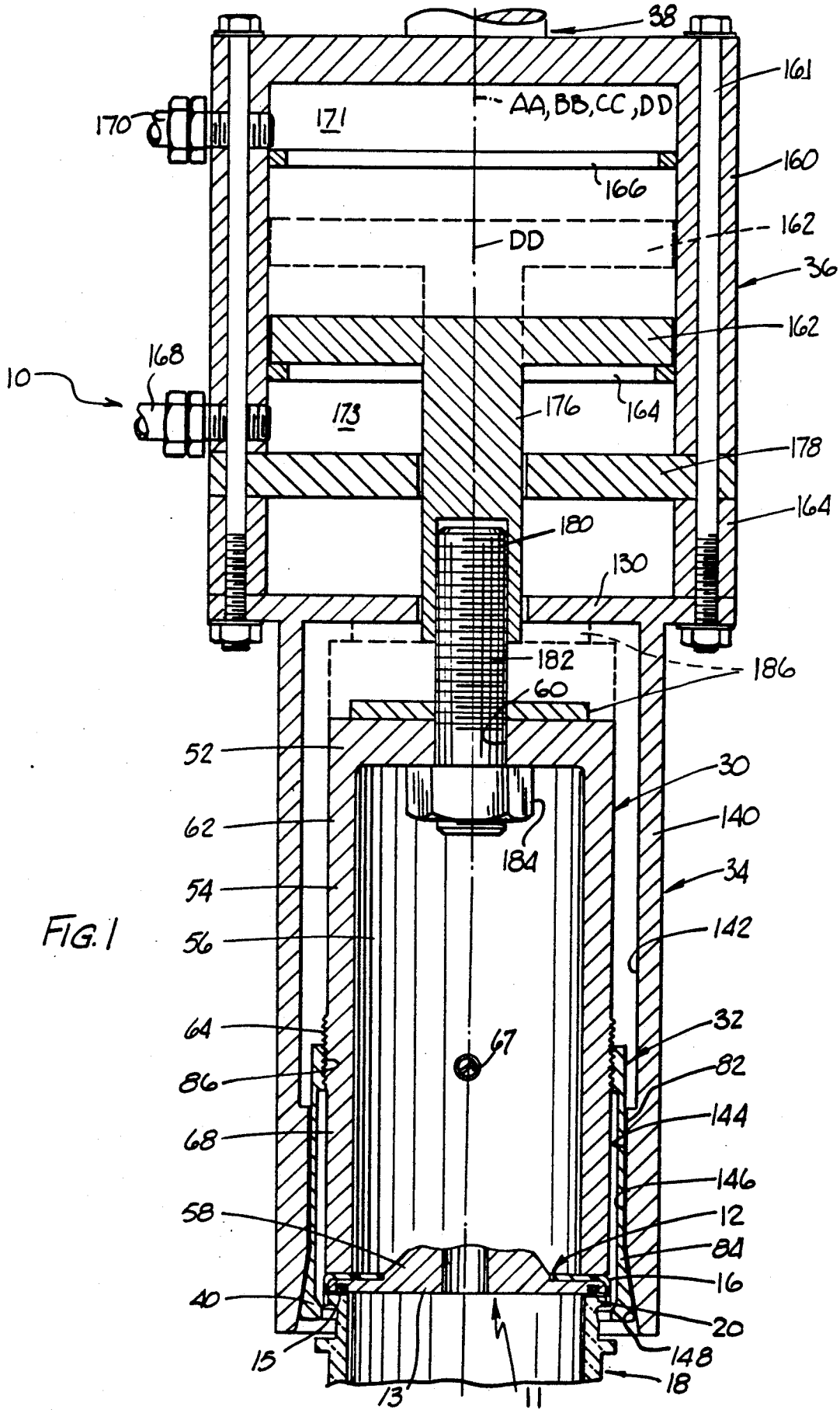
FIG. 1 is a cross sectional elevation view of a crimping tool supported in nesting relationship with a container cap and neck.

FIG. 1 illustrates a crimping tool 10 adapted for attaching a cap member 12 having a radially extending central body portion 14 and an axially extending skirt portion 16 to a flange portion 20 of the neck 19 of a container 18.

Figure 2:
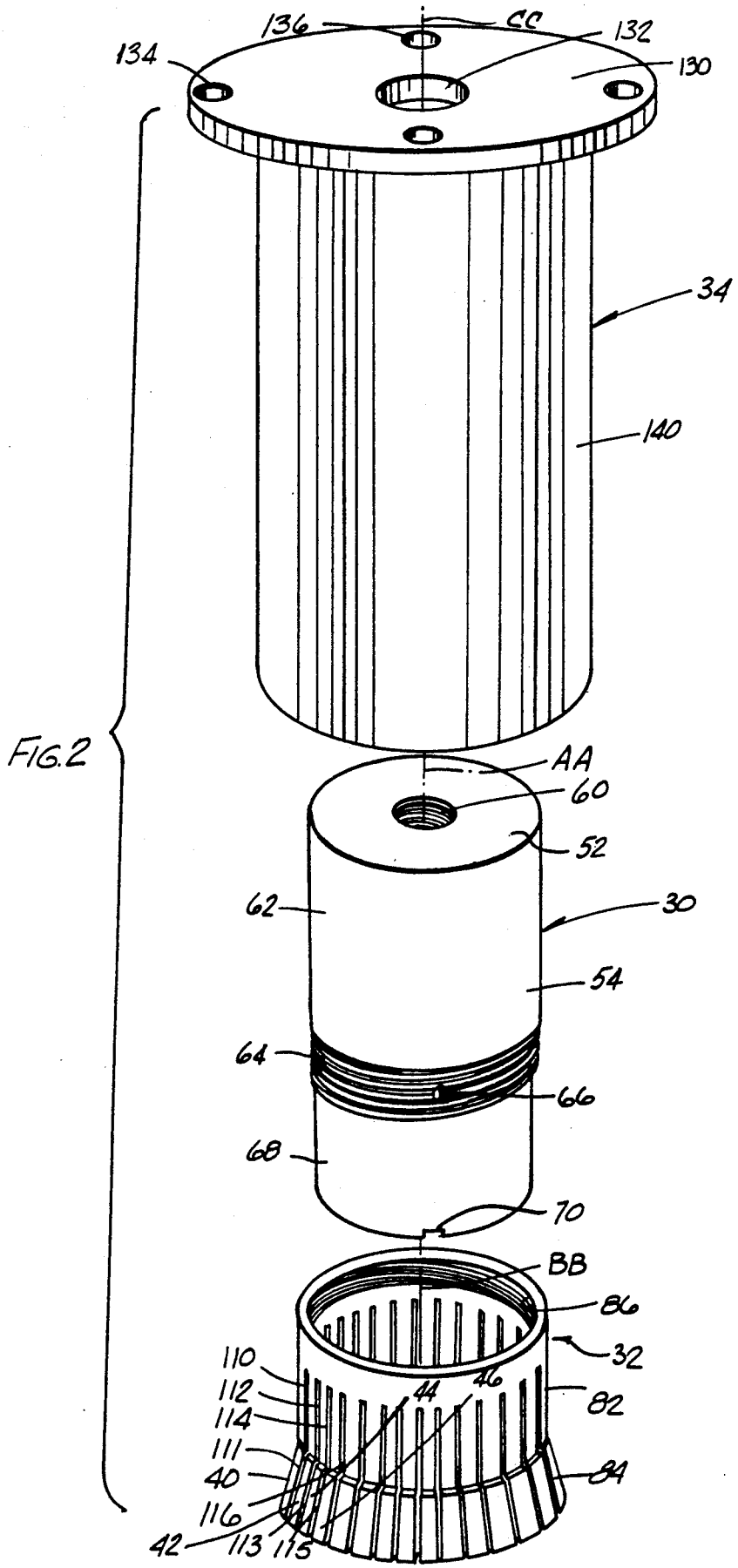
FIG. 2 is an exploded perspective view of a sleeve member, nest member, and collet member of a crimping tool.

The crimping tool 10 has a nest member 30, FIGS. 1 and 2, which is adapted to axially locate the crimping tool at a predetermined position relative to the cap member 12.

Figure 4:
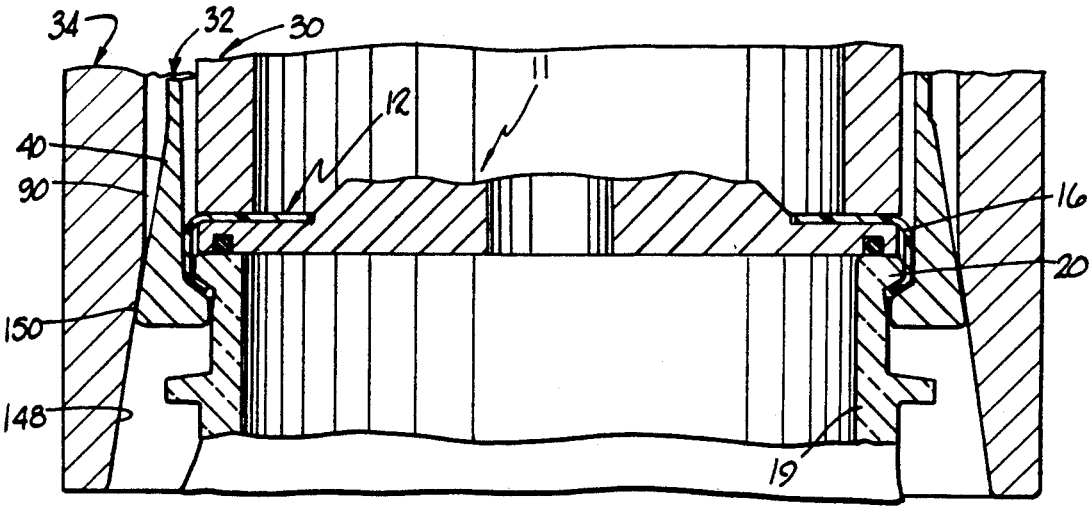
FIG. 4 is a detail elevation view of the crimping tool of FIG. 1 with the jaws positioned in engaged relationship with a container cap.

A unitary collet member 32 mounted on the nest member in stationary relationship therewith is adapted to engage the skirt portion 16 of the cap member. The collet member has integrally formed, elastically deformable jaw portions 40, 42, 44, 46, etc., FIG. 2, which radially inwardly displace a lower end of the skirt portion 16, crimpingly deforming it about the container neck flange 20 as shown in FIG. 4.

A sleeve member 34 is positioned in circumscribing relationship about the collet member 32 and is axially displaceable with respect to the collet member. Sleeve member 34 is adapted to engage a lower portion of the collet member 32 to urge the collet member into crimping relationship with the cap member skirt portion 16, FIG. 4, during downward displacement of the sleeve member 34 relative to the collet member 32. Subsequent upward displacement of the sleeve member 34 enables the collet member 32 to elastically return to a relatively outwardly displaced position with respect to cap 12, as illustrated in FIG. 3.

An axial displacement device 36 is mechanically linked to the collet member 32 and the sleeve member 34. The axial displacement device 36 may be selectively actuated by an operator, as through a foot switch 174, FIG. 5, to axially upwardly and downwardly displace the sleeve member relative to the collet member.

Figure 5:
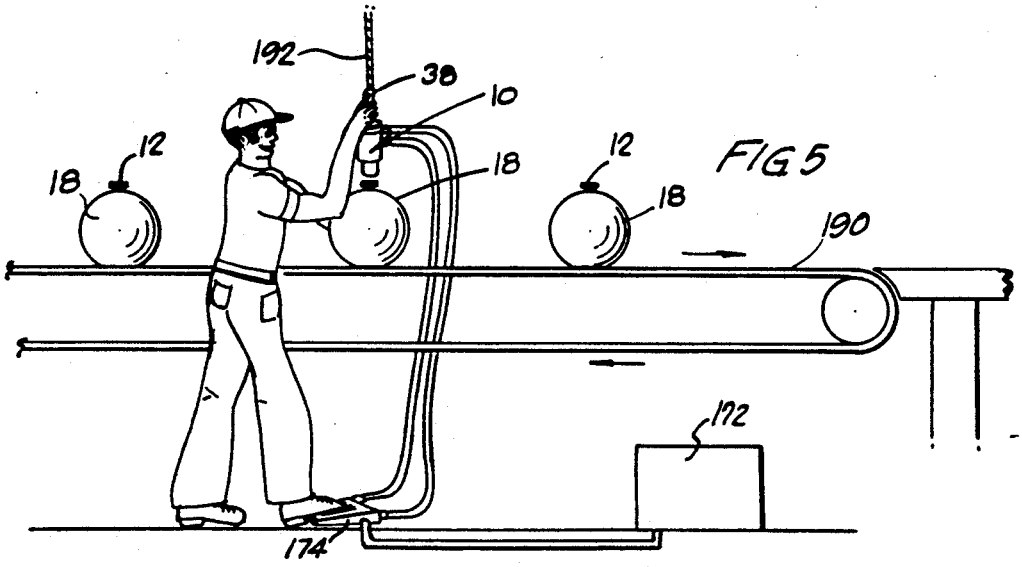
FIG. 5 is a schematic drawing illustrating use of a crimping tool in a production setting.

The crimping tool may comprise a handle member 38, FIGS. 1 and 5, which facilitates handling of the device by an operator.

Figure 3:
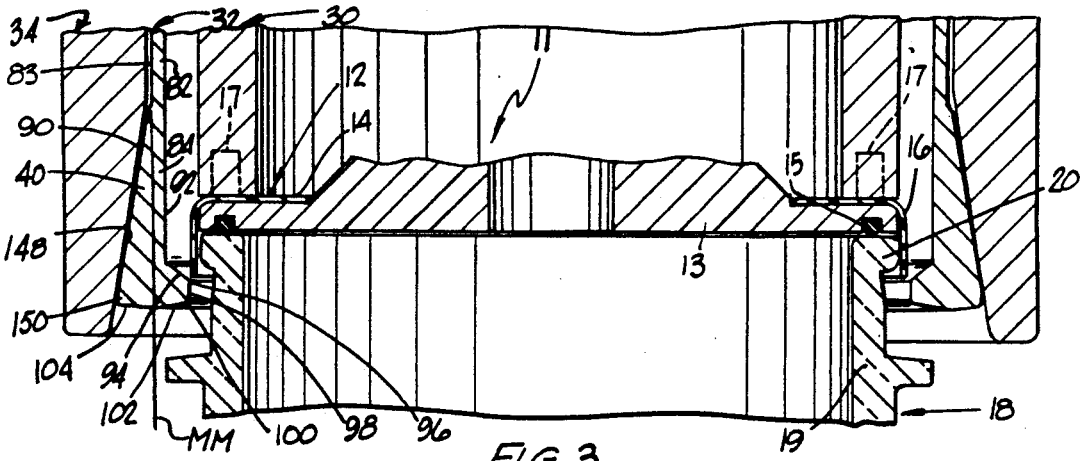
FIG. 3 is a detail elevation view of the crimping tool of FIG. 1 with the jaws positioned in disengaged relationship with a container cap.

In use, an operator positions the nest member 30 upon a cap member 12 of a closure and valve assembly 11 which is loosely mounted on a container 18, FIG. 3. The integrally formed collet member 32 is initially positioned in spaced apart, circumscribing relationship with the cap member skirt portion 16. Next, the collet member jaw portions 40, 42, etc., are elastically inwardly and slightly upwardly deformed so as to cause the jaw portions to engage and crimpingly deform the cap member skirt portion 16 around the container neck flange 20. This inward and upward displacement of the collet member jaw portions is produced by the coaction of beveled surface portions of the collet member 32 and sleeve member 34 during relative downward movement of the sleeve member 34 with respect to the collet member 32. After crimping attachment of a cap member 12 has been completed, the collet member 32 is enabled to elastically return to the relatively outwardly displaced, unstressed position illustrated in FIG. 3 by upwardly displacing sleeve member 34 with respect to the collet member 32. Sleeve member 34 is upwardly and downwardly axially displaced relative collet member 32 through operator actuation of axial displacement device 36. After a cap 12 has been crimped to a container 18, the operator lifts the crimping tool 10 from the cap to complete the capping operation.

Having thus described the structure and operation of crimping tool 10 in general, further details thereof will now be described.

Closure and Valve Assembly

Closure and valve assembly 11 includes a cap member 12 which is used to attach the assembly 11 to a container 18, a valve body 13 (only partially shown) rests on the container and projects upwardly through a central hole in the cap member 12, and an O-ring 15.

Cap member 12 of closure and valve assembly 11 may be constructed from 0.020-inch-thick cold-rolled steel and may include a central body portion 14 having an outer diameter of 2.925 inches and an axial skirt portion 16 having an axial length of 0.320 inches.

O-ring 15 may be mounted in an annular groove provided in valve body 13. O-ring 15 when compressed by cap 12 and valve body 13 during the crimping process create an air-tight seal around the periphery of container neck 19.

In an alternative embodiment such as disclosed in U.S. patent application Ser. No. 450,924 referenced above, the closure assembly may comprise a continuous cap and gasket assembly.

Nest Member

As best illustrated in FIGS. 1 and 2, nest member 30 may comprise a generally cylindrically shaped member having a top wall 52 and a sidewall 54 defining a cylindrical cavity 56 having a circular lower opening 58. Nest member 30 may have an axial length of 6.000 inches and a maximum outside diameter of 3.000 inches. The nest member is of sufficient axial length to accommodate upwardly projecting valve body 13. In a use application where the closure assembly 11 does not include such an upwardly projecting valve body, the nest member may have a substantially smaller axial length.

A threaded bore 60 which extends through top wall 52 in coaxial relationship with the central longitudinal axis AA of the nest member. Top wall 52 may have a thickness of, e.g., 0.500 inches.

Sidewall 54 may comprise an upper sidewall portion 62 having an outer diameter of 3.000 inches, an inner diameter of 2.400 inches, and an axial length, measured from the top of the nest member, of 3.275 inches.

Sidewall 54 may comprise an intermediate, externally threaded portion 64 having outer and inner diameters equal to those of the upper portion 62 and an axial length of 0.750 inches. A radially extending threaded bore 66, FIG. 2, may be provided in sidewall intermediate portion 64 to facilitate securing the collet member 32 in fixed axial relationship with nest member 30 through use of a set screw 67, FIG. 1, as described in further detail hereinafter.

Sidewall 54 may also include a lower portion 68 having an inside diameter equal to those of the upper and intermediate sidewall portions 62, 64; an outer diameter of 2.870 inches; and an axial length of 1.975 inches.

A pair of diametrically oppositely positioned notches 70 (only one shown) may be provided at a bottom terminal edge of the lower sidewall portion 68 to facilitate threading attachment of the nest member to a threaded adapter stud 182, as described in further detail below.

Nest member 30 may be constructed from 304 stainless steel and may incorporate magnets, e.g. magnets 17 shown in phantom in FIG. 3, to enable a cap member 12 to be magnetically held in contact therewith as described in further detail below.

Collet Member

As best illustrated in FIGS. 1 and 2, collet member 32 is a unitary tubular member having a central longitudinal axis BB. Collet member 32 may have a total axial length of 2.900 inches.

Collet member 32 has a sidewall comprising a generally cylindrical upper portion 82 and a downwardly and outwardly extending lower portion 84. Upper sidewall portion 82 may have an outer diameter of 3.285 inches and an axial length of 2.093 inches. The interior diameter of collet member upper sidewall portion may be 3.165 inches throughout except for an uppermost interiorly threaded region 86 having an axial length of 0.375 inches and having a thread pattern adapted to threadingly mate with externally threaded portion 64 of nest member 30.

The collet member lower sidewall portion 84, as best illustrated in FIG. 3, may comprise an outer beveled surface 90 which is inclined outwardly at an angle of 8.75° with respect to the outer surface 83 of upper sidewall portion 82. (Reference line MM is an axial extension of the outer surface of upper sidewall portion 82). The lower sidewall portion may comprise an interior surface having an upper region 92 having a diameter equal to that of the inside diameter of upper sidewall portion 82. Surface 92 may be integrally connected to an inwardly and downwardly sloping surface 94 which may be inclined downwardly and inwardly at an angle of 30° with respect to a radial plane. Surface 94 may be connected by a shoulder portion 96 having a radius of 0.06 inches to an axially extending surface 98 having an axial length of 0.125 inches and having a diameter of 2.945 inches when the collet member is in an unstressed state such as illustrated in FIG. 3. Axially extending surface portion 98 may be connected by a shoulder portion 100 having a radius of 0.04 inches to a first bottom surface 102 which is inclined downwardly and outwardly at an angle of 10° with respect to a radial plane. A second bottom surface 104 is connected to first bottom surface 102 at a point defined by projection MM. Surface 102 slopes upwardly and outwardly from a radial plane at an angle of 5°.

As best illustrated in FIG. 2, a plurality of evenly circumferentially spaced, axially extending saw cuts 110, 112, 114, 116, etc., define collet member jaw portions 40, 42, 44, 46, etc. Each saw cut may be 0.032 inches wide. In one preferred embodiment, thirty equally circumferentially spaced saw cuts are provided to define thirty deflectable jaw portions 40, 42, 44, etc. Each axial saw cut 110, 112, 114, etc., may terminate at a distance of 0.500 inches from the upper terminal end of the collet member so as to define jaw portions having an overall axial length of 2.400 inches.

In addition to jaw-defining saw cuts 110, 112, 114, etc., a series of axially extending relief cuts 111, 113 115, etc., having a width of 0.043 inches may be provided in an outer portion of the lower portion 84 of the collet member. These relief cuts are centered on and overlap each of the jaw-defining cuts 110, 112, 114, etc., and extend from outer surface 90 radially inwardly to a position, as indicated by reference line MM which is an extension of upper sidewall 82 exterior surface 83.

With the above described saw cuts, the collet jaw portions may be elastically urged together by the sleeve member into touching adjacent relationship such that axially extending surface 98 comprises a diameter of 2.712 inches.

Collet member 32 may be constructed from type 420 stainless steel.

Sleeve Member

As best illustrated in FIGS. 1 and 2, sleeve member 34 may comprise a top wall 130 having a diameter of 5.500 inches and a wall thickness of 0.313 inches. Top wall 130 may comprises an axial bore 132 extending in coaxial relationship with the central longitudinal axis CC of the sleeve member. Bore 132 is adapted to allow reciprocal movement of a piston shaft 176 therewithin as described in further detail below. Top wall 130 also comprises a plurality of peripheral bores 134, 136, etc., for enabling attachment of axial displacement device 36 as described in further detail below.

Sleeve member 34 may comprise a cylindrical sidewall 140 which may have an outer diameter of 4.000 inches. Cylindrical sidewall 140 may comprise an upper interior surface portion 142 having a diameter of 3.548 inches and may have a lower interior surface portion 144 having an upper region 146 with a diameter of 3.296 inches which is integrally connected with a lower region 148 having an axial length of 1.194 inches and having a downwardly and outwardly tapering surface inclined at an angle of 7° from the vertical which tapers to a diameter of 3.589 inches at a 30 lower terminal end of the sleeve member 34. Thus the jaw portions comprise beveled surface portions 90 sloping outwardly and downwardly relative the central longitudinal axis of the sleeve member at a first acute angle, and the sleeve member comprises a beveled inner surface portion 148 sloping radially outwardly ad downwardly at a second acute angle, the first acute angle being greater than the second acute angle (preferably about 2–5 degrees greater) whereby the beveled surface portion 90 of the jaw portions are adapted to make line contact with the sleeve member beveled portion 148.

The overall axial length of the sleeve member may be 7.888 inches. The sleeve member may be constructed from type 440 stainless steel.

Axial Displacement Device

Axial displacement device 36 may comprise a conventional power cylinder such as an air cylinder which may be of the type sold under product style designation Flat-1 which is commercially available from Bimba Manufacturing Co., Monee, Ill. The air cylinder, which has a central longitudinal axis DD, comprises a cylinder barrel 160 which may be attached by means of screws 161 and an annular spacer member 164 to the top wall 130 of sleeve member 34 in coaxial relationship therewith.

A reciprocal piston 162 is mounted within cylinder barrel 160 and is ordinarily displaceable between a lower stop surface 164 and an upper stop surface 166 by compressed air entering and discharging through cylinder ports 168, 170. The compressed air may be provided by a compressor 172, FIG. 5, and air may be selectively injected and discharged from upper and lower cylinder regions 171, 173 through operator actuation of a valve assembly such as a conventional foot valve 174, FIG. 5.

Piston 162 is fixedly attached to a piston shaft 176 which reciprocally sealingly extends through a lower wall portion 178 of cylinder barrel 160. Piston shaft 176 may comprise a threaded axial bore 180 in the lower end thereof which is adapted to threadingly receive a male adapter stud 182.

Stud 182 is also threadingly received within bore 60 of nest member 30 and is fixedly secured in adjustable axial relationship therewith by nut 184. A shim member 186 of selected axial dimension may be slidingly received around stud 182. Through selection of the appropriate shim thickness the stroke length of piston 162 may be selectively adjusted. The uppermost position of piston 162, with shim 186 in place, is illustrated in phantom lines in FIG. 1. The stroke length of piston 162 determines the maximum amount of axial displacement of sleeve member 34 relative to nest collet member 32 which in turn determines the maximum amount of inward radial displacement of the collet 32 jaw portions, as described in further detail below.

Assembly

Assembly of the various components of the crimping tool 10 will now be described. As illustrated in FIG. 1, the axial displacement device (power cylinder) 36 is fixedly mounted to the top of sleeve member 34 in coaxial relationship therewith as by bolts 161. A spacer 164 may be provided as an adjustment to a fixed stroke air cylinder. Next, stud 182 is threadingly mounted in piston bore 180. The assembly is then inverted and a shim 186 of a selected size is positioned around stud 182.

Next, collet member 32 is threaded onto nest member 30 to a selected axial position thereon and locked in a fixed axial relationship therewith by means of set screw 67. The axial distance between the bottom of collet member 32 and the bottom of nest member 30 is selected based upon the desired axial relationship between collet member 32 and cap member 12. (Although this axial dimension should be relatively constant for any particular series of crimping operations, it may vary somewhat depending on variations in cap thickness, cap gasket 13 thickness, etc., from one batch of caps to the next. To the extent that the axial relationship between collet member and nest member requires change, adjustment is easily made through loosening the set screw 67, threadingly adjusting the collet member 32 to the appropriate axial position and retightening the set screw.)

Next, the nest member 30 is threadingly mounted on stud 182 and secured in fixed axial relationship therewith by means of nut 184. The axial position at which the nest is secured to stud 182 is selected such that sleeve member 34 is positioned at a predetermined relatively raised location, e.g. FIG. 3, with respect to collet 32 when piston 162 is at its lowermost position, i.e. the position shown in solid lines in FIG. 1.

Operation

As shown in FIGS. 3 and 4, inward deflection of the collet member jaw portions 40, 42, 44, etc., is produced by coaction between the outer beveled surface 90 of each jaw portion and the inner beveled surface 148 of sleeve member 34. Surfaces 90, 148 are preferably highly polished surfaces to minimize friction. A lubricant may be applied to surfaces 90, 148 to further reduce friction. Surface 148 makes sliding, contact with surface 90 at region 150 at the lower end of each jaw member. Restricted, nominal line contact between surfaces 90 and 148 is provided due to the fact that surface 90 is inclined downwardly and outwardly slightly more, e.g. 1.75° more, than surface 148 when the collet jaw portions are in their undeflected state.

Relative downward movement of sleeve member 34 with respect to collet member 32, e.g. movement from the position shown in FIG. 3 to the position shown in FIG. 4, causes the jaw portions 40, 42, etc., of collet member 32 to be displaced radially inwardly and slightly upwardly by sleeve member 34. Relative upward movement of sleeve member 34 with respect to collet member 32, e.g. movement from the position shown in FIG. 4 to the position shown in FIG. 3, enables jaw portions 40, 42, etc., to progressively elastically return to the unstressed position illustrated in FIGS. 2 and 3.

Relative axial movement between collet member 32 and sleeve member 34 is provided by the axial displacement of piston 162. Upward displacement of piston 162 produces downward displacement of the sleeve member 32, and downward displacement of piston 162 produces upward displacement of sleeve member 32. Since the radial displacement of collet jaw portions 40, 42, etc., is a function of the axial displacement between collet member 32 and sleeve member 34 and since the axial displacement between collet member 32 and sleeve member 34 is a function of piston 162 displacement, the amount of radial displacement of jaw portions 40, 42, 44, etc., may be controlled by controlling the piston stroke length. The piston stroke length, as discussed above, is controlled by selection of the axial dimension of shim 186 — the thicker the shim, the shorter the piston stroke and the smaller the total radial displacement of jaw portions 40, 42, etc.

When the pressure in upper piston chamber 171 is greater than that in lower chamber 173, piston 162 is caused to move downwardly to the stop position illustrated in solid lines in FIG. 1, causing sleeve member 34 to occupy the relatively upwardly displaced position illustrated in FIG. 3. Collet jaw portions 40, 42, 44, etc., are correspondingly radially outwardly positioned.

When upper chamber 171 is depressurized and lower chamber 173 is pressurized, piston 162 moves upwardly to the stop position shown in phantom lines in FIG. 1, causing sleeve member 32 to move to the relatively downwardly displaced position illustrated in FIG. 4. The downward displacement of sleeve member 32 produces the relative inward displacement of jaw portions 40, etc., shown in FIG. 4. The inward displacement of jaw portions 40, 42, etc., produces the crimping attachment of cap 12 to container neck 19 illustrated in FIG. 4. The piston stroke length is selected so as to produce enough inward displacement of jaw portions 40, 42, etc., to provide a good crimp and tight cap attachment and yet is not so much displacement as to cause damage to container neck 19.

Use of the Apparatus

As illustrated in FIG. 5, in a typical industrial use, the crimping tool 10 is suspended above a conveyor belt 190 as by a bunge cord 192 which resiliently supports a portion of the weight of the tool 10. An operator grasps the crimping tool 10 by handle 38 and moves the tool into and out of working engagement with containers 18 being moved along the conveyor belt 190.

In the assembly mode illustrated, each of the incoming containers 18 has a cap member 12 loosely positioned thereon. The crimping tool 10, with the collet jaw portions in the retracted position of FIG. 3, is nested on top of the cap member such that the bottom surface of nest member 30 rests on the central body portion 14 of cap member 12.

Next, the operator actuates a valve, e.g. foot valve 174 or alternatively a thumb valve provided in handle 38 (not shown), causing air from compressed air source 172 to upwardly displace piston 162 within cylinder barrel 160 causing relative downward displacement of sleeve member 30 with respect to collet member 32. This relative downward movement of sleeve member 34 causes the jaw portions of collet member 32 to be radially inwardly displaced to the position illustrated in FIG. 4. At this position, the jaw portions have engaged the cap member skirt portion 116 and have urged it around the container neck flange 20 thereby crimpingly attaching the cap member 12 to the container 18.

Next, the operator deactivates foot valve 174 causing piston 162 to be relatively downwardly displaced to the position illustrated in solid lines in FIG. 1, thus causing sleeve member 34 to be upwardly displaced to the position illustrated in FIG. 3 thereby removing the inwardly directed force from the collet member jaw portions enabling the jaw portions to elastically return to the position illustrated in FIG. 3. The crimping tool 10 is then removed from the container 18 and the same process is repeated for the next container 18.

In a slight modification of the above procedure in which nest member 30 is a magnetic member, cap members 12 are not mounted on incoming containers 18 but are rather supplied directly to the operator who hand-inserts each cap member 12 into abutting relationship with the lower end portion of magnetic nest member 30. The operator thereafter moves the crimping tool with the attached cap member 12 into engagement with an incoming container 18 to provide the configuration illustrated in FIG. 3. Thereafter, the same series of steps as described above is undertaken to crimpingly attach the cap member 12 to a container 18.

While a illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A crimping tool for attaching a cap member to a container neck flange, comprising:

(a) next means for axially locating said crimping tool at a predetermined position relative to said cap member;

(b) unitary collet means mounted in fixed axial relationship with said nest means for engaging and crimpingly deforming said cap member about said container neck flange, said collet means comprising an integrally formed member having a generally cylindrical cavity defined by a tubular sidewall;

(c) sleeve means positioned in circumscribing relationship with said collet means in axially displaceable relationship therewith for engaging a lower portion of said collet means and urging said collet means into crimping relationship with said cap member during axial displacement of said sleeve means relative said collet means; and (d) axial displacement means mechanically linked to said collet means and said sleeve means for selectively axially displacing said sleeve means relative said collet means said collet means comprising a plurality of radially deflectable jaw portions defined by a plurality of circumferentially spaced, axially extending, radial cuts through said tubular sidewall; wherein said jaw portions each comprise: a first radially outwardly located, unstressed position and a second radially inwardly located, stressed position associated with crimping engagement of a cap member skirt portion; and said jaw portions being deflectable from said first position to said second position by said sleeve means and being elastically deflectable from said second position to said first position; said sleeve means comprising beveled inner surface portion adapted to coact with predetermined outer surface portions of said jaw portions for urging said jaw portion radially inwardly during axial displacement of said collet means relative said sleeve means; said sleeve means inner beveled surface portion being formed at a lower end portion thereof; said predetermined outer surface portions of said jaw portions which coact with said beveled surface portion of said sleeve means being provided at lower end portions of said jaw portions; said predetermined outer surface portions of said jaw portions comprising beveled surface portions sloping outwardly and downwardly relative the central longitudinal axis of said sleeve means at a first acute angle, said sleeve means beveled inner surface portion sloping outwardly and downwardly at a second angle, said first acute angle being greater than said second acute angle whereby said beveled surface portions of said jaw portions are adapted to make line contact with said sleeve means beveled surface portion.

2. The invention of claim 1 said sleeve means beveled inner surface portion sloping radially outwardly and axially downwardly at an angle of between 5° and 10° from a central longitudinal axis of said sleeve means.

3. The invention of claim 2, said beveled surface portions of said jaw portions sloping outwardly and downwardly relative the central longitudinal axis of said sleeve means at an angle of between 2° and 5° greater than said slope of said beveled surface of said sleeve means when said jaw portions are in an undeflected state.

4. The invention of claim 2, said sleeve means beveled inner surface portion sloping radially outwardly and downwardly at an angle of approximately 7° from a central longitudinal axis of said sleeve means.

5. The invention of claim 1, said collet means being adjustably axially positionable with respect to said sleeve means.

6. The invention of claim 5, said collet means being threadingly adjustably axially positionable with respect to said sleeve means.

7. The invention of claim 1, said axial displacement means comprising a power cylinder assembly.

8. The invention of claim 7, said power cylinder assembly comprising:

(a) a cylinder barrel portion fixedly mounted on an upper end portion of said sleeve means; and (b) a piston portion reciprocally mounted within said barrel portion and having a piston shaft fixedly attached to said nest means.

9. The invention of claim 8 further comprising stop means limiting the relative upward axial displacement of said nest means and said collet means relative said sleeve means, comprising:

(a) an upper radial wall portion of said sleeve means; and (b) at least one shim mounted on an upper radial wall portion of said nest means and adapted to engage said upper radial wall portion of said sleeve means.

* * * * *